United States Patent [19]

Hattersley, Jr.

[11] Patent Number: 4,643,368

[45] Date of Patent: Feb. 17, 1987

[54] CONTINUOUS SPOOLER FOR AND METHOD OF WINDING REELS WITH SELECTED LENGTH LONG ENDS

[75] Inventor: Harold J. Hattersley, Jr., Bricktown, N.J.

[73] Assignee: Syncro Machine Co., Perth Amboy, N.J.

[21] Appl. No.: 821,699

[22] Filed: Jan. 13, 1986

Related U.S. Application Data

[63] Continuation-in-part of Ser. No. 529,584, Sep. 6, 1983, abandoned.

[51] Int. Cl.[4] ..... B65H 54/02; B65H 67/052

[52] U.S. Cl. ..... 242/25 A

[58] Field of Search ..... 242/25 A, 25 R, 18 A, 242/18 PW, 18 R

[56] References Cited

U.S. PATENT DOCUMENTS

| | | | |
|---|---|---|---|
| 2,763,442 | 9/1956 | Bruestle | 242/25 A |
| 3,011,730 | 12/1961 | Martino | 242/25 A |
| 3,082,967 | 3/1963 | Hyprath et al. | 242/25 A |
| 3,086,721 | 4/1963 | Duff | 242/25 A |
| 3,368,765 | 2/1968 | O'Grady | 242/25 A |
| 3,620,482 | 11/1971 | Braven | 242/25 A |
| 3,621,190 | 11/1971 | Morikawa et al. | 242/25 A |
| 3,625,448 | 12/1971 | Griffiths | 242/25 A |
| 3,698,652 | 10/1972 | Morikawa et al. | 242/25 A |
| 3,761,030 | 9/1973 | Leinonen et al. | 242/25 A |
| 3,768,751 | 10/1973 | Brown | 242/25 A |
| 3,831,871 | 8/1974 | Ikegami et al. | 242/25 A |
| 3,845,913 | 11/1974 | Hagen | 242/25 A |
| 4,030,673 | 6/1977 | Veyrassat | 242/25 A |
| 4,098,467 | 7/1978 | Engmann et al. | 242/25 A |
| 4,111,376 | 9/1978 | Hoddinott et al. | 242/25 A |
| 4,119,278 | 10/1978 | Draizen et al. | 242/25 A |
| 4,157,792 | 6/1979 | Wyckhuys | 242/25 A |
| 4,223,848 | 9/1980 | Brokke et al. | 242/25 A |
| 4,292,114 | 9/1981 | Engmann et al. | 242/25 A |
| 4,369,928 | 1/1983 | Riekkinen et al. | 242/25 A |
| 4,438,886 | 3/1984 | Meisser et al. | 242/25 A |
| 4,451,008 | 5/1984 | Veyrassat et al. | 242/25 A |

FOREIGN PATENT DOCUMENTS

| | | | |
|---|---|---|---|
| 2529764 | 1/1976 | Fed. Rep. of Germany | 242/25 A |
| 1309733 | 3/1973 | United Kingdom | 242/25 A |

*Primary Examiner*—Stanley N. Gilreath

*Attorney, Agent, or Firm*—Lilling & Greenspan

[57] ABSTRACT

A continuous dual spooler and a drive for driving the arbors selectively and controllably to wind wire on a full reel while stopping the other reel to permit replacement thereof with an empty reel. During transfer a snagger, mounted on a plate arranged for rotation about the axis of the reel, snags the wire and winds an initial number of turns of the wire onto the empty reel. Pins or other projections, mounted on a pin plate arranged substantially in the plane of the snagger plate for rotation about the axis of the reel, initially rotate in synchronism with the snagger plate and extends into the path of the snagged end of the wire when the snagger and pin plates rotate relative to each other. A control, together with the drive, temporarily disengage the arbor from the snagger and pin plate to allow free wheeling of the reel. Simultaneously the snagger and pin plates are rotated relative to each other a controlled amount to cause the pin or projection to engage the snagged end of the wire and unwind a desired amount from the initial turns of wire wound on the reel to provide a long end having a predetermined and predictable length.

17 Claims, 15 Drawing Figures

14a
26a
14
84
32
32
26
94
96
98
104
100
88
102
100
104
92
86
90
62
64a
62d
62c
CONTROL
C'
64b
62b
62a
64

CONTINUOUS SPOOLER FOR AND METHOD OF WINDING REELS WITH SELECTED LENGTH LONG ENDS

CROSS REFERENCE TO RELATED APPLICATION

This is a continuation-in-part application of U.S. patent application Ser. No. 529,584, filed on Sept. 6, 1983, now abandoned.

BACKGROUND OF THE INVENTION

The present invention generally relates to a the continuous spooling of wire, and more specifically to a continuous spooler for and method of winding reels with selected length long ends.

It is conventional for wire to be taken from a drawing machine or an extruder and continuously spooled on a pair of associated reels. See, for example, U.S. Pat. Nos. 2,763,442; 3,086,721; 3,368,765 and 4,119,278, all of which are owned by the Assignee of this application. As will be appreciated, it is undesirable that the wire-drawing machine or extruder be shut down to transfer the wire feed from a filled reel to an empty one. Therefore, means have been devised to automatically shift the wire from a full reel to an empty one while the wire-drawing machine or extruder remains in operation. The reels are normally mounted side-by-side on parallel axes as described in the above-referenced patents.

In a variety of applications of spooled wire, it is frequently desirable that both the starting (or inside) and the terminal (or outer) ends of the wire of the full reel be readily accessible prior to unwinding. This simplifies "follow-on" processes, since ends can then be joined to assure continuous operation. For this purpose, it is preferred that the inside wire end have a preselected desired length typically 2–3 ft. so as to facilitate such a process.

Virtually all of the devices which have hitherto been proposed for providing a long free inner-end on a reel uses some variation of a false coiling core, either a separate auxiliary spool, separate from the main core, or a structure which is built into the flanges of the main winding core. In many of the prior art spooling arrangements, a dummy spool is used adjacent to a main and the wire must go over the flanges when the long end is formed. This frequently results in a instantaneous change in velocity with a resultant increase in the tension in the wire as the wire crosses over the flange from one diameter to the other. Such changes in tension and abrupt discontinuities in the movements of the wire often create elongation and breakage of the wire. More importantly, wire in such spoolers typically advance at very high speeds.

At 6,000 ft. a minute, one second represents 100 ft. of wire movement. Even small errors, therefore, in the timing of feeding wire on to the false or dummy spool can create in excess of 30 ft. of unnecessary and undesired wire on the long end which simply has to be cut off and discarded as scrap.

Timing, therefore, is very critical. If the wire is wound onto the dummy spool even a fraction of a second too long, tens of feet can be added onto the dummy spool. Clearly, such excessively long ends are totally useless and must be cut to desired lengths of between 2 to 3 feet. The excesses are merely scrap which must be discarded—a costly waste. If winding of the dummy spool is too short the inside ends may be too short and may not be able to be used in a continuous wire feeding process.

For the aforementioned spoolers, the lengths of the inside long ends can be controlled somewhat better as the speed of the drawing or extrusion line is reduced during the period that the long ends are produced. however, this may significantly and adversely effect the productivity of the line since one must not only consider the time taken to slow down the spooler but as well the time to bring entire line back to its normal operating speed.

Other disadvantages of the prior art spoolers include the fact that they frequently scratch the wire, particularly as the wire is guided over a reel flange between the main and dummy spools. Additionally, the spoolers of the type under discussion cannot normally be used, for example, when winding aluminum or hard filament materials. The movement of such hard filaments over a flange, as suggested above, and change in the velocity of the wire would likely result in the breakage of the wire.

SUMMARY OF THE INVENTION

In view of the drawbacks of the existing prior art continuous spoolers, one object of the present invention is to provide such a spooler which produces a long end having a selected controlled and desired length of wire at the starting (inside) end of the reel.

It is another object of the present invention to provide a spooler for winding reels with selected length long ends continuously onto reels without the need to stop the spooler.

It is still another object of the present inention to provide a spooling device apparatus which allows continuous winding of bobbin spools to provide selected desired long inner ends while allowing the machine to continue operation at substantially full operating speed during winding as well as transfer of wire from one bobbin to the other.

It is a further object of the present invention to provide a continuous spooler for winding reels with selected length long ends which is more convenient and more efficient to operate than the prior art spoolers.

It is still a further object of the present invention to provide a spooling machine of the type under discussion which can be used for spooling soft as well as with hard materials.

It is yet a further object of the present invention to provide a continuous spooler which can provide selected length long ends while minimizing breakage, stretching or scratching of the wire during the spooling process, thereby enhancing the quality of the wire.

It is an additional object of the present invention to provide a spooler of the type above suggested which produces inner long ends having desired selected lengths which are not too long or too short and, therefore, which eliminates substantial quantities of scrap material which have resulted in the use of prior art devices.

In order to achieve the above objects, as well as others which will become apparent hereafter, a continuous spooler in acordance with the present invention comprises a housing and two spaced arbors mounted for rotation on the housing and adapted to mount reels for rotation therewith. Drive means is provided for driving and arbors to wind wire on an empty reel while slowing down and stopping the other full reel thereby permitting replacement thereof with an empty reel. Guides bring the wire proximate to the empty reel during transfer of the wire from the full reel to the empty reel. Cutter means provided for severing the continuous incoming wire and the full reel during wire transfer. Snagger means are associated with each arbor for snagging the wire at the empty reel at the commencement of wire transfer for winding initial turns of wire onto the empty reel. Wire take-off means are associated with each arbor for engaging the snagged wire between said snagger means and the empty reel and for unwinding a length of wire from the initial turns of wire wound on the empty reel. Control means are provided for timing and controlling the snagger and take-off means relative to said arbors and the reels to provide the full reels with long ends having predetermined desired lengths.

BRIEF DESCRIPTION OF THE DRAWINGS

A better understanding of the present invention may be had from a consideration of the following detailed description, taken in conjunction with the accompanying drawings, in which.

DESCRIPTION OF THE PREFERRED EMBODIMENT

Figure 1:
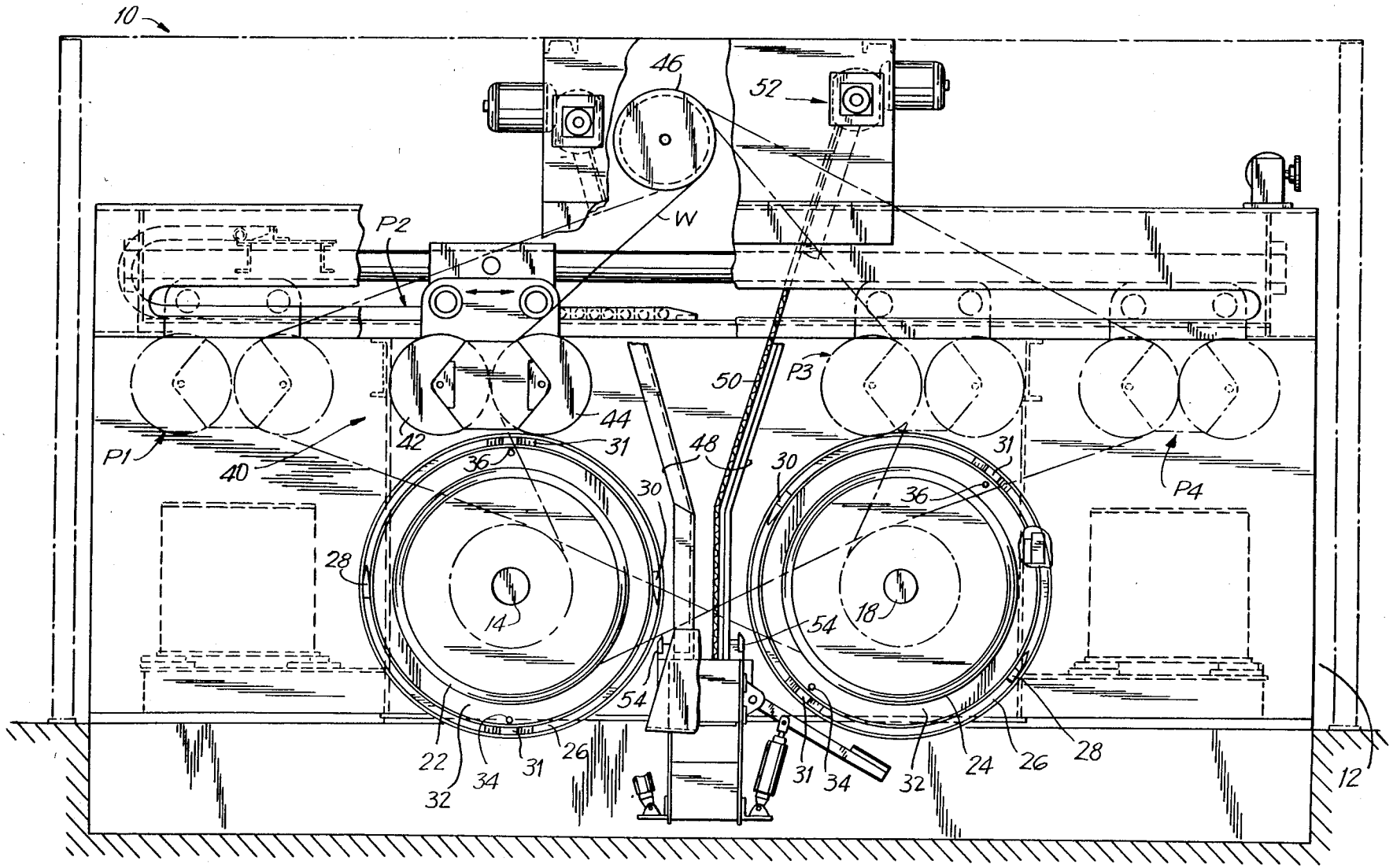
FIG. 1 is a front elevational view, in partial cross-section, of a complete spooler incorporating the present invention.

Turning now more specifically to the Figures, in which the identical or similar parts as designated by the same numerals almost throughout, and first referring to FIG. 1, a continuous spooler incorporating the structure for providing selected length long ends is shown and generally designated by the reference numeral 10.

The spooler 10 is similar in operation, in many respects, to the spooling apparatus disclosed in U.S. Pat. No. 4,119,278 assigned to the assignee of the present application. Many of the details which are considered to be known from the prior patent or prior art spoolers will not be discussed herein. Briefly, however, the spooler 10 includes a main housing 12 on which there is mounted a left arbor 14 and a right arbor 18 which may be driven by any suitable or conventional drive. A specific example of one embodiment will be more fully discussed below. The arbors 14, 18 are mounted for rotation on the housing 12 about substantially parallel axes and are adapted to mount reels 22, 24 for rotation therewith. The drives are arranged to drive the arbors 14, 18 in a predetermined sequence and for selected time intervals, as will be outlined hereinafter, to allow the winding of wire on an initially empty reel while slowing down and stopping the other full reel to thereby permit replacement thereof with an empty reel so that the winding process may be repeated continuously.

Figure 2:
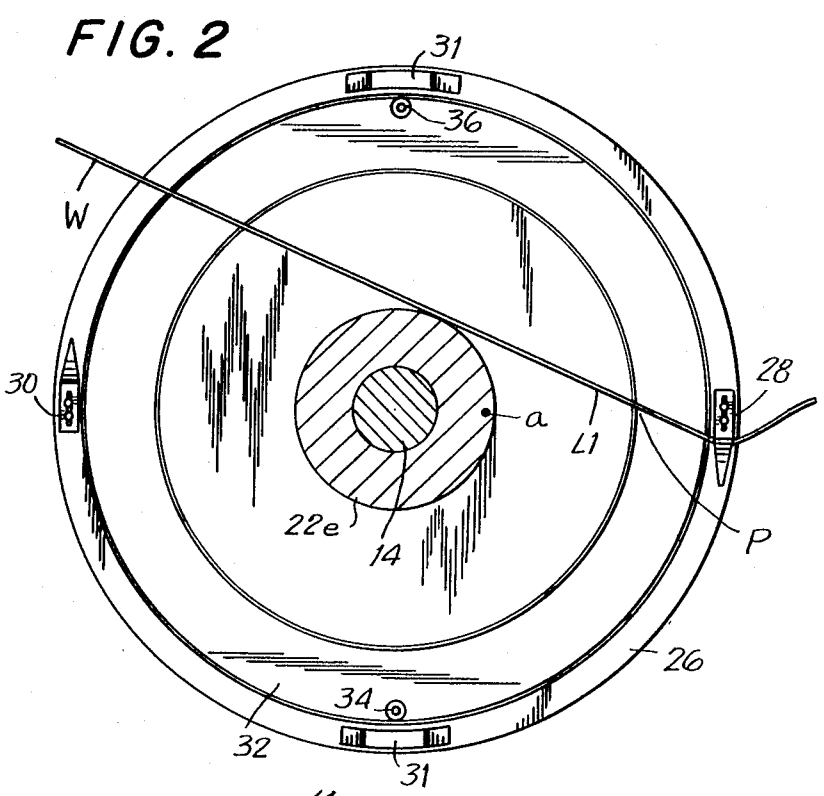
FIG. 2 is an enlarged front elevational view of the left arbor, showing in cross-section an empty reel and the position of the wire at the beginning of transfer.
Figure 3:
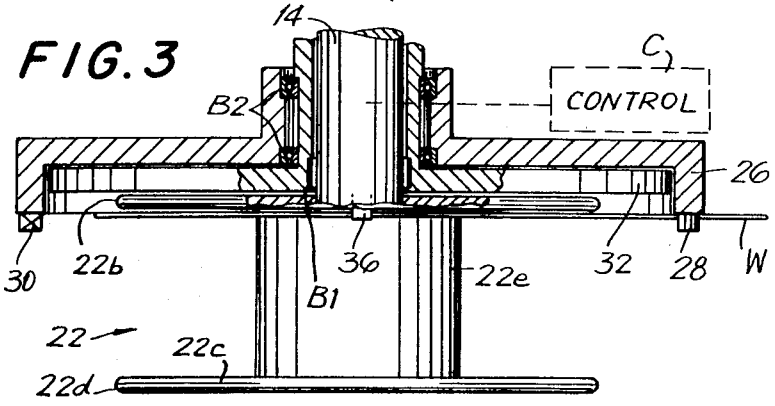
FIG. 3 is a top elevational view, partly in cross-section, showing the arrangement of FIG. 2 and, in dashed line, a control for regulating the relative rotational movements of the reel and associated components which come into play to provide a long end.
Figure 11:
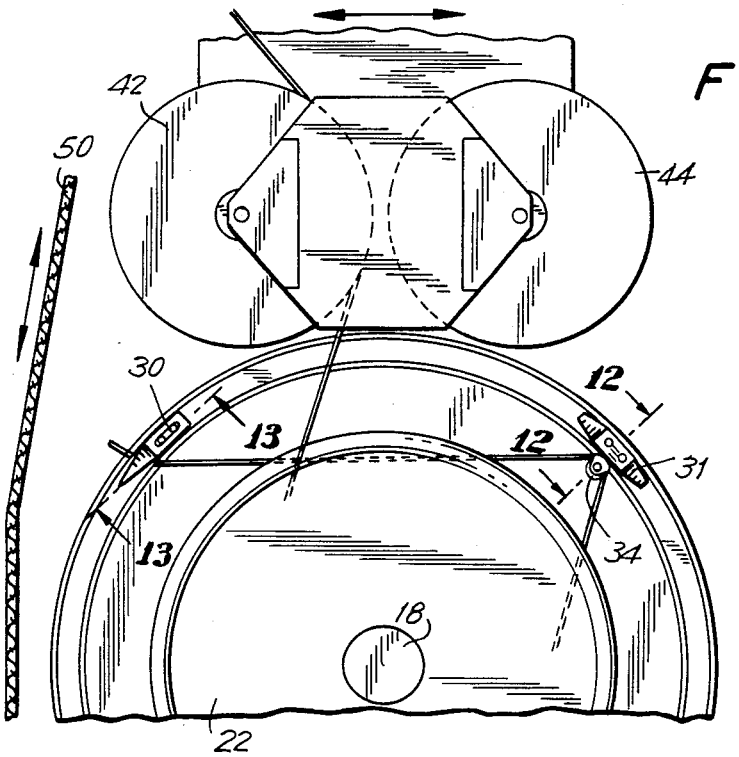
FIG. 11 is similar to FIGS. 2 and 4, showing the details of the wire path relative to the distribution pulleys and the long-end snagger and pin arrangement.

Now also referring to FIGS. 2 and 3, a snagger plate 26 is shown mounted for independent rotation about the axis of the arbor 14. Provided on the snagger plate 26 are a pair of snaggers 28, 30 which are disposed radially outwardly of the rim **22*b* of the flange 22*a* of a reel 22 mounted on the arbor 14 for snagging the wire at the commencement of wire transfer and for winding initial turns T (see FIGS. 4, 5 and 11) onto the empty reel 22. Additionally, ramps 31 are mounted on each snagger plate 26 displaced 90° from the snaggers 28, 30 and normally adjacent to the pins 34 to be described. The ramps 31 serve as a means for preventing the engagement of the wire W by the pins 34 prior to engagement by the snaggers 28, 30**.

Plate 32 is provided which is mounted for independent rotation about the axis of the arbor 14 in proximity to the flange **22*a* of the reel 22 and provided with wiring engaging members in the nature of pins 34, 36 disposed at radial distances between the reel rim 22*b* and the snaggers 28, 30 for engaging the snagged wire W at a radial distance between an associated snagger and the drum 22*e*** of the initially empty reel. Any other suitable engaging members may be used.

The plate 32 is shown rotatably mounted on the arbor 14 by means of bearings B1, while the snagger plate 26 is shown to be rotatably mounted on the shaft of the pin plate 32 by means of bearings B2. A control C may include mechanical components and electric circuitry for maintaining synchronous rotation between the arbor 14 and the snagger and pin plates 26, 32 during winding of a reel while free-wheeling the arbor 14 and reel 22 while selectively rotating the pin plate 32 relative to the snagger plate 26 during the transfer mode and during the formation of the desired long end as will be more fully explained hereafter. The specific way in which the pin and snagger plates are mounted in relation to the arbors and the precise nature of the control device C is not in and of itself critical for the purposes of the present invention and any suitable arrangements can be used which cause the spooler to operate as described.

As with the spooler of U.S. Pat. No. 4,119,278, there is provided a traverse assembly (FIGS. 1, 8 and 9) which is arranged to move a distributor wire guide 40 from one lateral end of the housing to the other end and intermediate positions identified by positions P1, P2, P3 and P4. The traverse guide 40 includes sheaves or pulleys 42 or 44 as shown for guiding a continuous incoming wire W which is supplied through auxiliary sheave or pulley 46 as shown.

Figure 4:
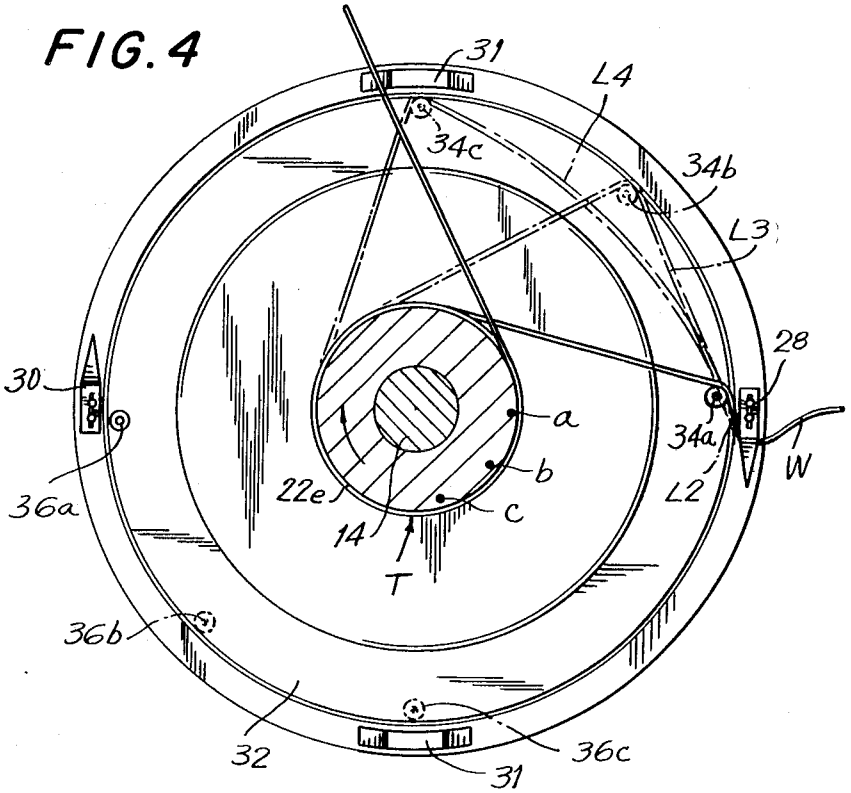
FIG. 4 is similar to FIG. 2, showing in dashed outline the relative rotational movements of the spooler components to achieve a long end having a desired length.
Figure 5:
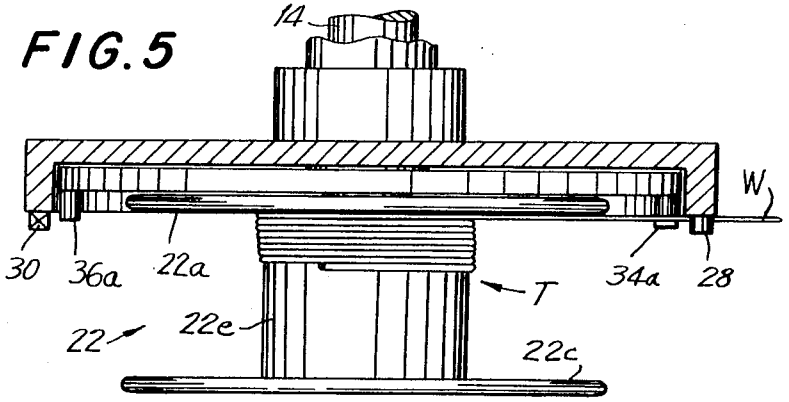
FIG. 5 is similar to FIG. 3, showing the condition of the bobbin reel after an initial number of turns have been wound and a long end produced.

In the position P2 of the distributor 40, shown solid in FIG. 1, the distributor 40 is positioned for winding of the wire W onto the left reel 22. The distributor 40, once winding of a reel commences, reciprocates along a direction generally parallel to the axis of the left arbor 14 so as to wind turns T onto the drum 22*e* of the reel 22 between the flanges 22*a* and 22*c*. The initial turns T wound on the drum 22*e* are shown in FIGS. 4 and 5. When wire is being wound onto the right reel 24, the distributor 40 assumes position P3 at which time winding takes place in a similar manner.

Figure 9:
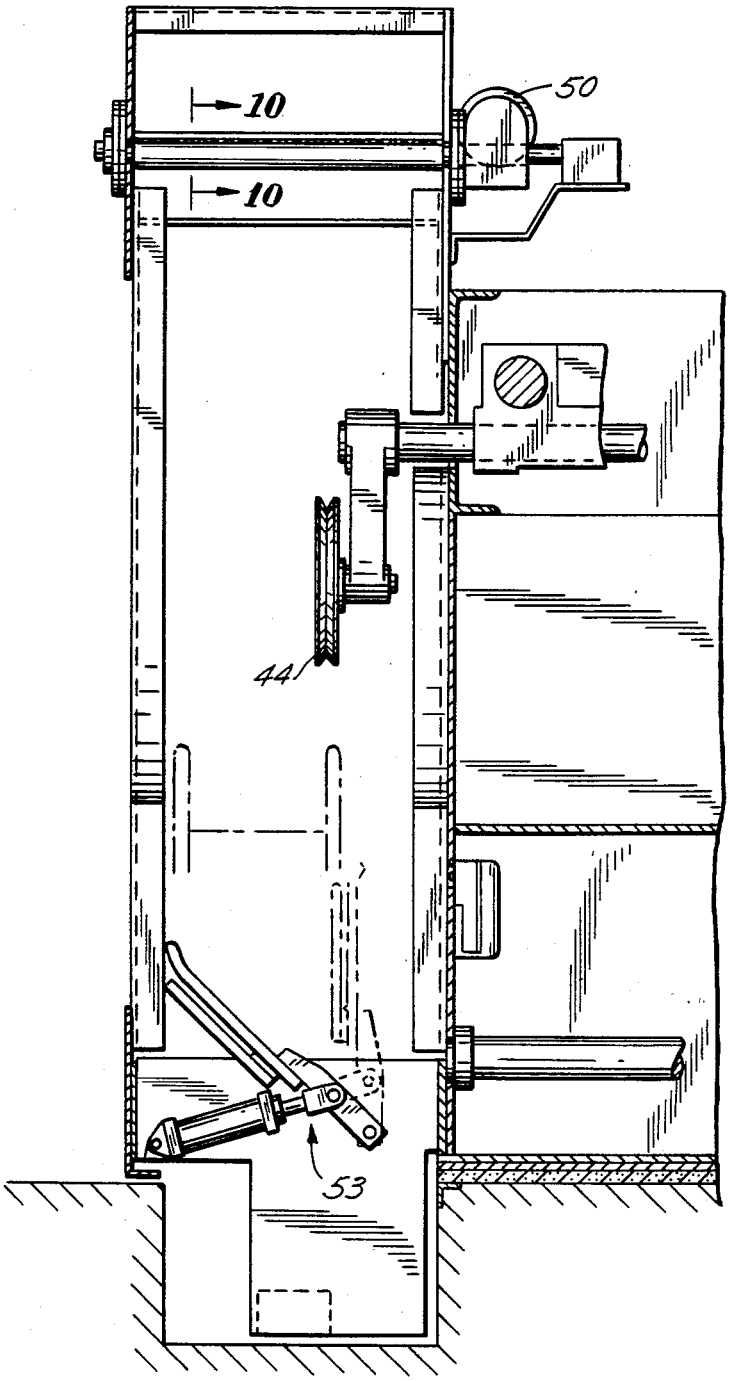
FIG. 9 is a side elevational view of the spooler shown in FIGS. 1 and 7, showing details of the curtain drive and the throw pin and cutter mechanism.
Figure 10:
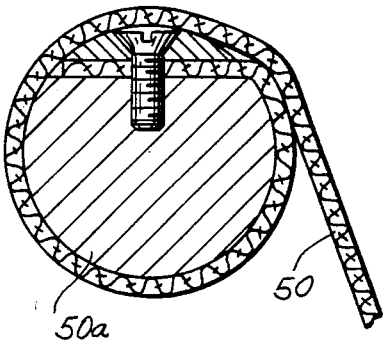
FIG. 10 is an enlarged cross-sectional view of the curtain drive shaft.

The spooler 10 is advantageously provided with curtain guides 48 as shown each arranged to support a curtain, such as a wire mesh curtain 50 as shown in FIGS. 1, 9 and 10, lowered onto the right curtain guide 48 by means of a drive 52. The curtain 50 serves to isolate the compartment in which the full reel is located so that it can be removed and replaced with an empty without danger of flying debris from the compartment in which the other reel is being wound with wire at a high speed.

The operation of the spooler will now be described. While the production of a long end will be described in conjunction with the left reel 22, supported on the arbor 14, it will be understood that the creation of a long end for the right reel 24 will be totally analogous and will be self evident from the description that follows.

In the discussion that follows, it will be assumed that the right reel 24 has been filled with wire W and an empty reel 22 has been positioned on the left arbor 14. As soon as the right reel 24 has been fully wound with the desired amount of wire, the distributor 40 moves from position P3 to position P1 at the far left of the housing 12. As the distributor reaches the position P1, the left reel 22 is set into rotary motion until its drum achieves a peripheral speed substantially equal to the speed of the wire. As will be noted from FIGS. 1 and 2, when the distributor 40 is in position P1 the wire W is substantially tangent to the drum 22*e* of the empty reel.

Initially, the control C causes the reel 22, the snagger plate 26 and the pin plate 32 to rotate synchronously as if they were rigidly connected. When the wire W is brought proximate to the inner most flange 22*a* of the reel 22, a conventional throw pin 53 (FIG. 9) adjacent to reel 22 deflects the wire W into the path of the rotating snaggers 28, 30. Substantially simultaneously therewith, the continuous wire W is cut by an appropriate cutter knife 54 (FIG. 1) so as to separate it form the full reel 24. Continued rotation of the left reel 22 causes an initial number of turns T to be wound onto the reel drum 22*e* as best shown in FIG. 5.

In order to create the long end having a predetermined desired length, the control C releases the arbor 14 to allow the left reel 22 to become free-wheeling unrestricted by the movements of the snagger plate 26 or the pin plate 32, while controlling the relative movements between the snaggers 28, 30 and the take-off pins 34, 36.

In FIG. 4, for the sake of clarity, the snagger plate 26 has been shown stationary during a successive series of relative positions between the reel 22, snagger plate 26 and the pin plate 32. Thus, FIG. 4 shows the relative movements of the reel 22, the snaggers 28, 30 and the take-off pins 34, 36.

Since the reels are generally wound substantially up to the rims 22*b*, 22*d* of the flanges, the only exposed wire remaining is that wire which extends beyond the flange rims from the point P in FIG. 2 to the free end of the wire at the place where it is cut during transfer. As will be appreciated, the initial length of the free end that would be formed using conventional spoolers would be too short and generally unacceptble.

Again referring to FIG. 4, the pin plate 32 is moved delayed relative to the snagger plate so as to cause the pin 34 to move to position 34*a* and engage the wire W generally in the area of the snagger 28. During this initial period, the length of the free end is increased by the distance L2. The pin 34 continues to move relative to the snagger and a further position is shown at 34*b* wherein the length of the free end has now been increased by the length L3. Further relative movement between the snagger and pin plates brings the pin 34 to position 34C, in which position the length of the free end has been increased by the distance L4.

In order to increase the length of the free end of the wire between the snagger 28 and the drum 22*e* of the reel, it will be clear that this can be done if at least a portion of the wire is unwound from the initial turns T wound on the reel 22. This is made possible by free-wheeling the arbor 14 and the reel 22 so that, relative to the snagger and pin plates 26, 32, the reel 22 can rotate and in effect unwind wire as required. During the free-wheeling period, the only force acting on the reel 22 and makes it spin besides inertia is the tension on the wire W. Thus, referring to FIG. 4, during the relative movements of the snagger and pin plates 26, 32 as described, the reel 22 and the arbor 14 are allowed to freely rotate from position "a" to positions "b" and "c" which corresond to position 34*a*, 34*b* and 34*c* of the pin 34. As shown, the reel 22 may rotate approximately 90° relative to the snagger plate 26 or an amount sufficient to unwind the necessary amount of wire from the reel. Once the long end having a desired length has been created, the control C again locks the arbor 14 and the snagger and pin plates 26, 32 to rotate rigidly or synchronously with each other. During the creation of the long end, however, as suggested, the reel 22 is free-wheeling and control C only regulates relative speed and direction in at which the pins 34, 36 move in relation to the snaggers 28, 30, as will be more fully discussed below.

The essence of the present invention, therefore, is the free-wheeling of the arbor to allow relative rotation between the initially wound reel and the snaggers and wire engaging members, and the simultaneously selective rotating of the wire engaging members relative to the snaggers to effectively unwind a selected desired length of wire from the initial turns wound on the drum of the reel. It will be appreciated that this method eliminates the prior art disadvantages since it does not require the wire to be forced over a flange onto a dummy spool. The wire, accordingly, is not stretched, scratched or otherwise damaged. Of greater importance, however, is that the apparatus and method of the present invention allow a long end to be produced which has a predetermined desired length which is totally predictable and repeatable. This assures that each reel wound will have at least a minimum desired long end while avoiding excessive lengths which simply create unnecessary scrap or waste.

The control C, as suggested above, can be any suitable mechanical or electromechanical device. For example, the control C may include clutches or separate drives which control the relative rotations of the arbors, snagger and pin plates. The presently preferred embodiment of control C, however, includes a differential transmission for controlling the relative rotations between the snagger plates 26 and the pin plates 32, and an air clutch for releasing the arbor 14, as will be more fully discussed in connection with FIGS. 7, 8, 14 and 15. Also, while the snagger and pin plates are shown to rotate 180° in the preferred embodiment, this is not a critical feature of the invention, although it eliminates the need for a secondary resetting operation since the snagger and pin plates are in the same relative positions before and after a long end is formed. In the event that a longer or shorter end is desired relative rotations of greater or less than 180°, respectively, can be preprogrammed. However, in that instance, the snagger and pin plates would have to be reset or returned to the initial positions shown in FIG. 2.

While the general principles of the invention have been described, additional design details will now be described in connection with a preferred embodiment or realization of the invention.

Figures 6, 7:
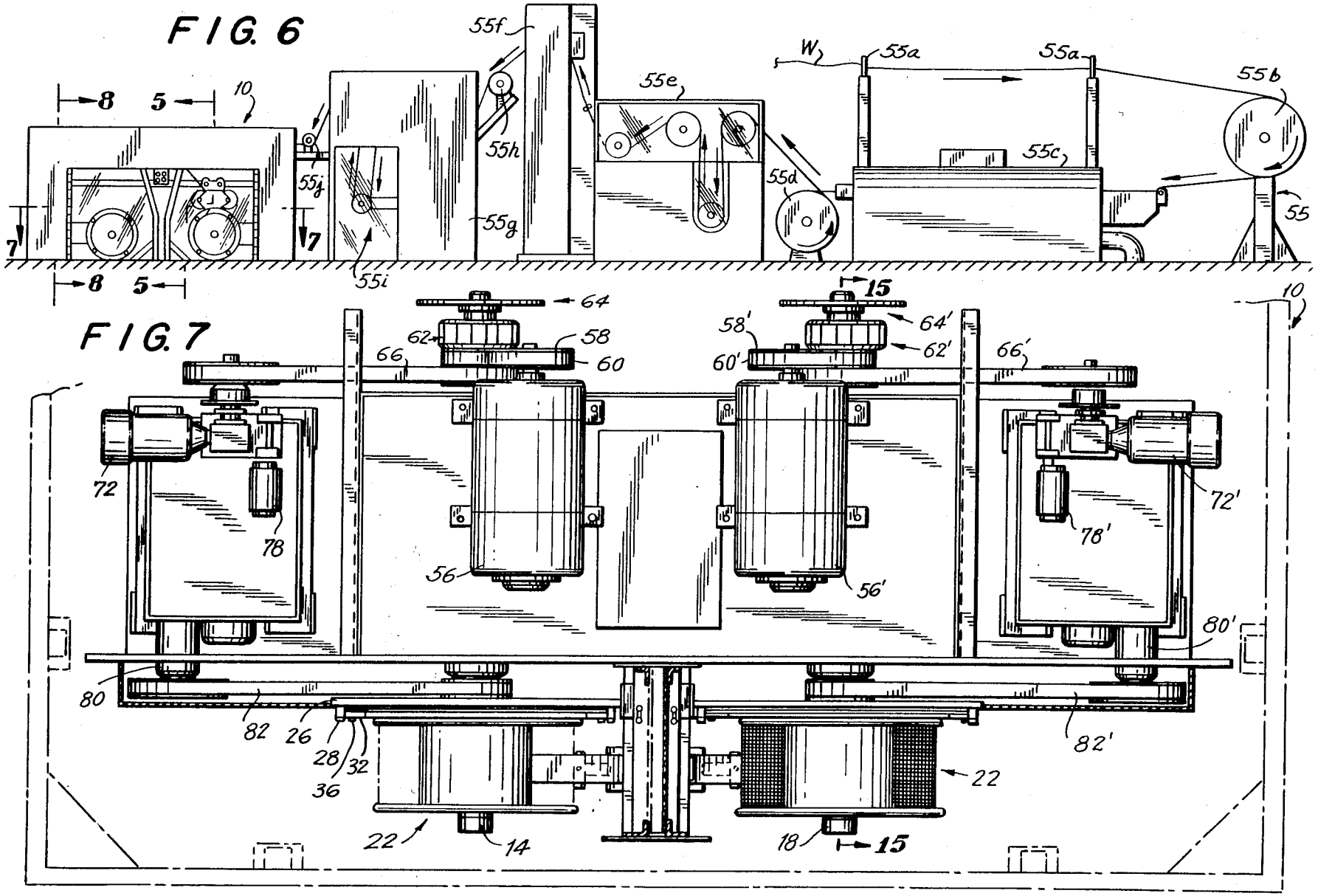
FIG. 6 is a side elevational view showing a wire drawing line which the subject invention can typically be used.
FIG. 7 is a top plan view of the complete spooler shown in FIG. 1, showing additional details of the drives for driving the reels.

Referring to FIG. 6, a wire drawing line, generally designated by the reference numeral 55, is shown, in which the spooler 10 can typically be used. The line 55 receives raw or bear cope and is fed by means of guides 55*a* to a turnaround reel 55*b* and redirected to a wire drawing machine 55*c* which breaks the copper rod to a selected gauge wire. The wire is pulled out at the output of the drawing machine 55*c* by a capstan wheel 55*d* and the wire is directed to an annealer 55*e* which restores the ductility to the wire lost in the wire drawing machine 55*c*. The wire is then fed to a cooling box 55*f* of the annealer 55*e*, both the annealer 55*e* and the cooling box 55*f* being optional since the line can also run hard wire.

A buffer 55*g* receives the wire from the cooling box 55*f* and includes a series of pulleys and dancer mechanisms 55*h*, 55*i* and 55*j* which coordinates the spooler speed with the feeding rate which is a function of the wire drawing machine 55*c*. The buffer 55*g* also controls and/or sets the tension in the wire at a relatively fixed tension for the spooler 10.

Figure 8:
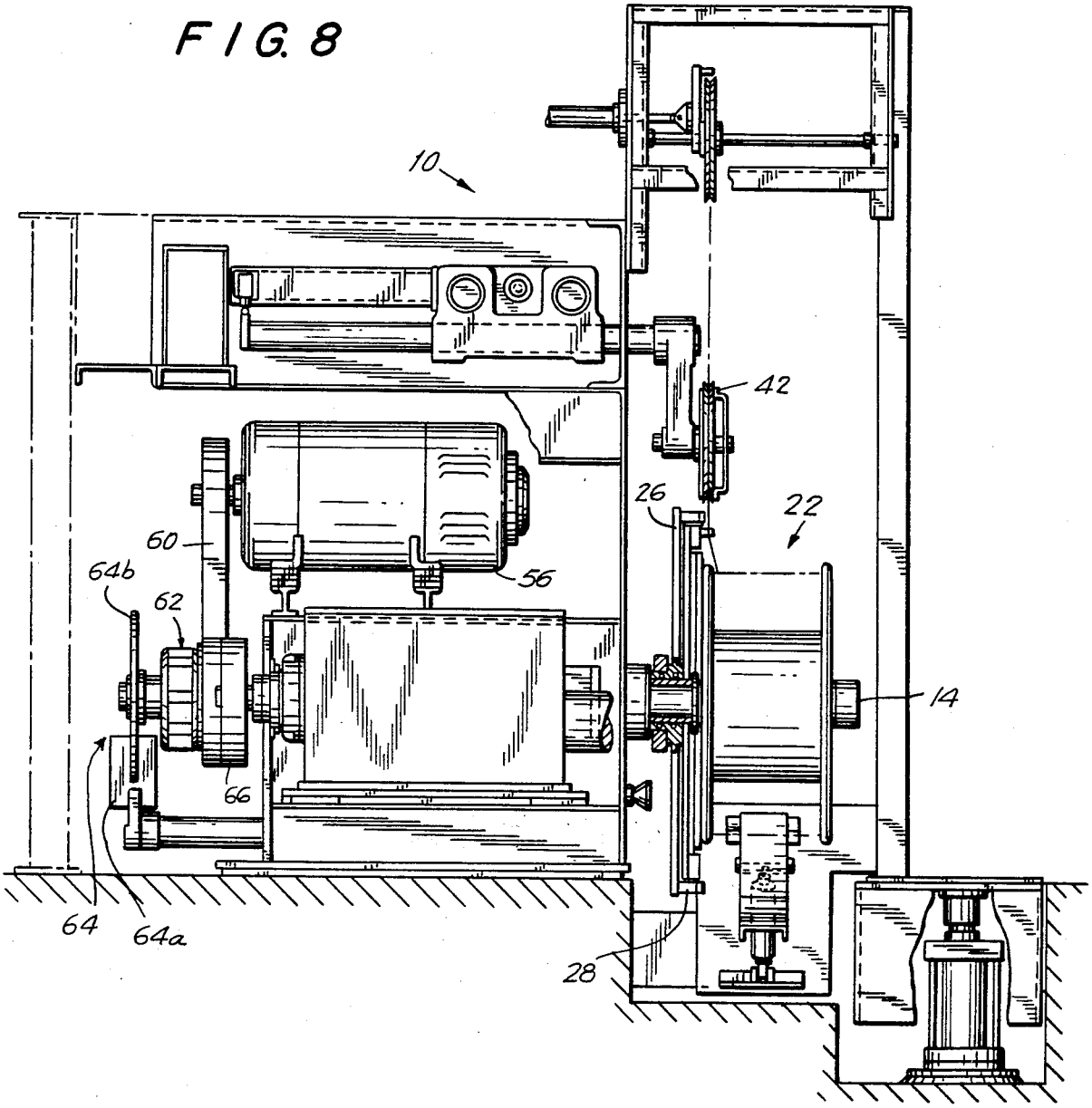
FIG. 8 is a side elevational view of the spoolers shown in FIGS. 1 and 7.

Referring to FIGS. 7, 8 and 9, the control C shown in FIG. 3 includes an arrangement of drive shafts, drives and brakes and control elements. A main or primary drive motor 56 is shown mounted generally above from the left arbor 14. Since the mechanical elements for both the left and right arbors 14, 18 are generally the same and are symmetrically arranged in relation to the center of the machine, they generally form mirror images of each other and the description for the left part of the machine equally applies to the right side of the machine wherein prime numbers are used to designate similar parts.

The drive motor 56 includes a pulley 58 which is coupled to the pin plate 32 and to the arbor 14 by means of a drive belt 60, as will be more fully described in connection with FIG. 15. An air clutch 62 and a brake 64 are used to lock the various rotating elements during the wire winding phase while releasing or insuring predetermined desired relative rotations during the long end forming phase.

A belt 66 engages the pin plate drive shaft as well as a pulley 68 mounted on an input shaft of a differential drive 69, another or second input of the differential drive being coupled by means of a chain 70 to a sprocket wheel of an AC gear motor 72. A second sprocket wheel driven by the gear motor 72 is coupled by means of a chain 74 to a proximity switch 76 which is, in turn, connected to an electromagnetic counter 78. The output 80 of the differential drive 69 (FIG. 7) is coupled by means of a snagger belt 82 to the hub for driving the snagger plate.

The differential drive 69 is arranged so that when the gear motor 72 does not rotate so that one of the inputs to the differential drive is equal to 0, the output of the differential drive 80 rotates at the same speed as the primary input which corresponds to the speed of the pin plate. Under such conditions, the pin plate 32 and the snagger plate 14*a* are driven at the same rotational speed.

Once the wire has been transferred from reel to the other and the transfer cycle has been completed, a timing device can be used to time a short interval, (e.g. 1–2 seconds) to allow some initial turns to be wrapped around the reel drum, as described above, before activating the gear motor 72. Once the gear motor 72 is activated, it feeds, by means of chain 70, a second input to the differential drive 69 and causes the output 80 of the differential drive to increase in velocity, thereby increasing the rotational speed of the snagger plate 14*a* in relation to the pin plate 32.

Figure 15:
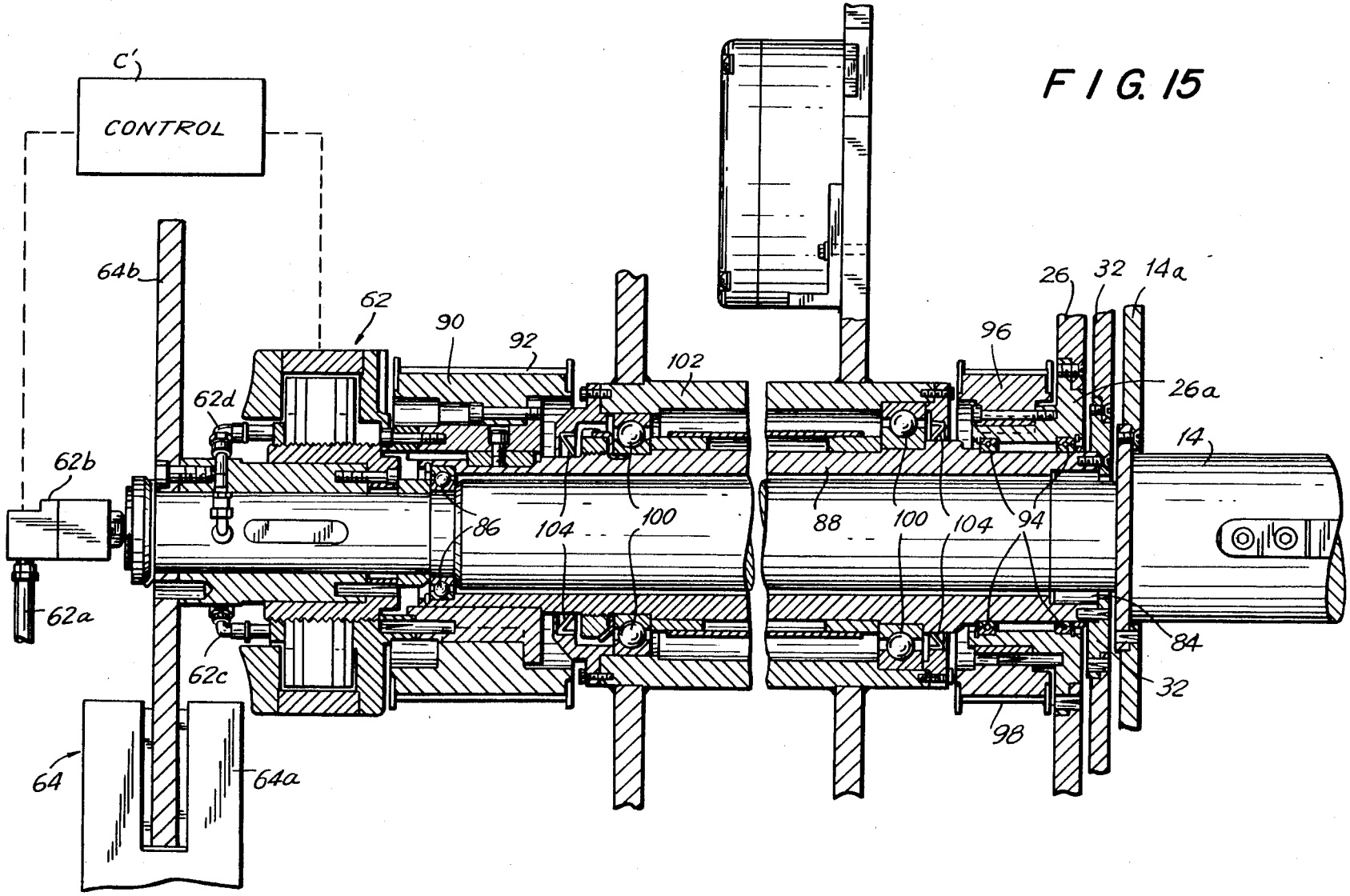
FIG. 15 is an enlarged cross-sectional view of the shaft, clutch and breaking members or elements for controlling the rotation of the snaggers, pin plate and arbor shaft for the right side of the machine.

Referring to FIG. 15, one possible arrangement of drive shafts and braking mechanisms is illustrated which can be used to implement the inention.

The arbor shaft 14 together with arbor or bobbin wall plate 14*a* are rotatably supported on needle bearings 84 (bearing B1 in FIG. 3) and bearings 86 which support the arbor 14 shaft within pin plate shaft or rotating housing 88 for the arbor shaft which is connected at one end to the pin plate 32 and pin plate drive hub 32*a* and at the other free end is provided with an oversized pulley 90 with gear teeth 92. The gear teeth 92 engage both the main drive belts 60 as well as the differential drive input or feedback belt 66. The pulley 90 is connected to the air clutch 62 which includes a flexible steel hose 62*a* which couples air under pressure through a rotary union 62*b* through nipples 62*c* and 62*d* to the air clutch proper. The central disk of which is secured on the arbor shaft 14.

Also rotatably mounted on the pin plate shaft 88 by means of bearings 94 is a snagger plate hub 26*a* which is connected to the snagger plate 26 and supports a pulley 96 provided with gear teeth 98. The gear teeth 98 of the snagger pulley 96 engages the snagger plate belt 82 which is also coupled to the output of the differential drive 69.

The pin plate shaft 88 is rotatably supported by means of bearings 100 within stationary plates or members 102 which are rigidly connected to the housing of the machine. Advantageously, oil seals 104 are used as shown.

Also referring to FIG. 15, the brake 64 consists of a caliper 64*a* and a brake disk 64*b* which is connected on the arbor shaft 14.

Control C' in FIG. 15 represents hydraulic controls which are actuated at appropriate times during the operation of the machine.

During the normal wire winding phase of winding wire onto a reel, as suggested, the arbor shaft 14, the snagger plate 26 and the pin plate 32 all rotate synchronously. During this time, the air clutch 62 locks the pin plate shaft 88 to the arbor shaft 14 and, since the gear motor 72 is de-energized and the differential drive 69 only receives one input, the output 80 which drives the snagger plate rotates at the same speed as the speed of the pin plate shaft 88. Once the long end forming phase initiates, the air clutch 62, under the action of the control C', releases the arbor shaft 14 so that it becomes free wheeling and is no longer locked to the continued rotation of the pulley 90 and the pin plate shaft 88. This free wheeling of the reel on the arbor shaft 14 permits an unwinding of some of the wire from the reel drum without imparting excessive shock or damaging the wire. Once the snagger plate 26 and the plate 32 have rotated 180° relative to each other and a long end has been formed, the control C' again causes the air clutch 62 to engage the arbor shaft 14 thereby again locking the two relative to each other and transmitting the drive to the pulley 90 also to the arbor shaft 14, and the reel is again accelerated to the speed of the pin plate 32.

It will be noted that the hub 26*a* for the snagger plate 26, while rotatably mounted on the pin plate shaft 88 is not coupled by means of clutches or brakes to any other member other than through the differential drive by means of the belts 82.

The brake 64 is actuated at the end of a wire winding phase, once a bobbin is full and transfer has been effected, to decelerate and stop the full reel so that it can be removed from the spooler 10 and a new empty reel mounted.

Figure 12:
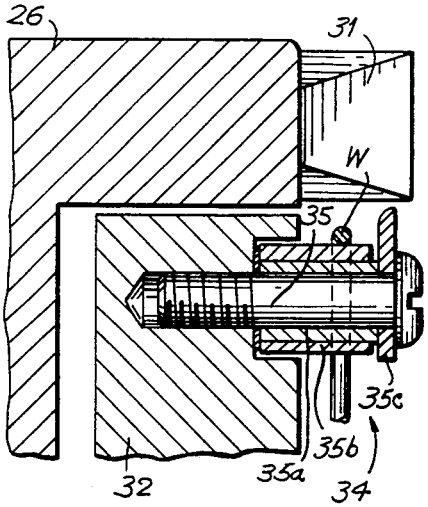
FIG. 12 is a enlarged cross-sectional view of the pin on the pin plate and the ramps on the snagger plate, taken along line 12—12 in FIG. 11.
Figure 13:
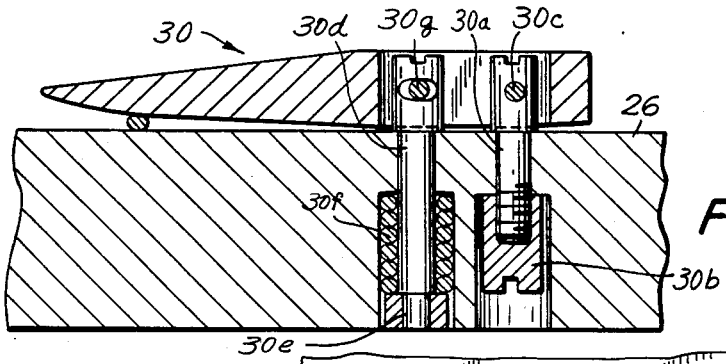
FIG. 13 is an enlarged cross-sectional view of the snagger taken along line 13—13 in FIG. 11.
Figure 14:
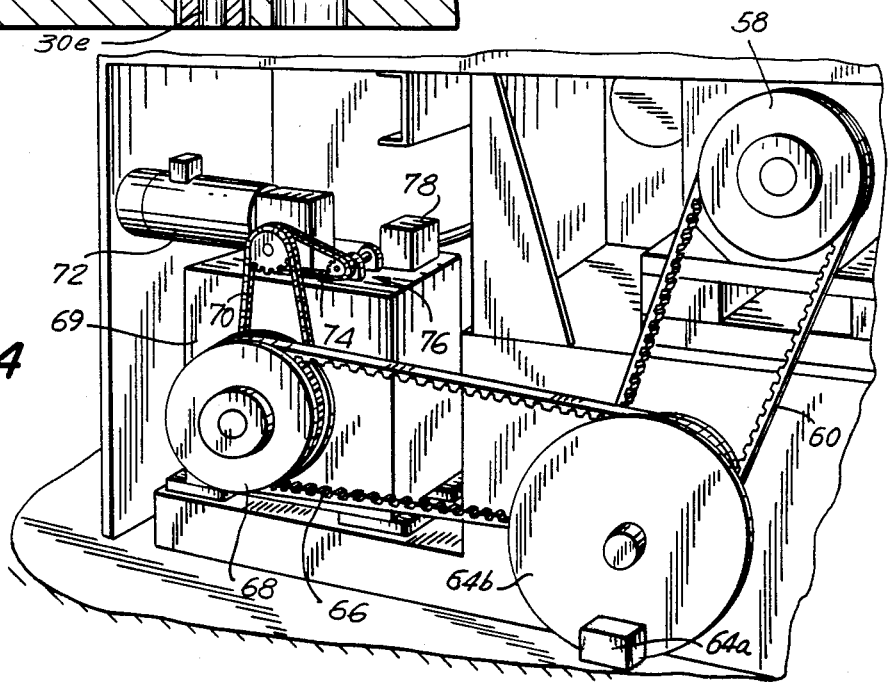
FIG. 14 is a perspective view of the right side of the spooler, showing differential drive arrangements for controlling the driving for the snagger plate.

Referring to FIGS. 9 and 10, there is shown a shaft 50*a* which is used to raise or lower the curtain 50 (FIG. 1) and the curtain drive motor 50*b* which can be energized after a bobbin has become full and the brake 64 has been engaged. Referring to FIGS. 12 and 13, some details of a pin and of a snagger are shown. The pin 34 is secured to the pin plate 32 by means of a bolt 35. Bronze and iron sleeves 35*a*, 35*b* are shown on the bolt for engaging the wire W. A steel washer 35*c*, which is eccentric, is shown for insuring that the wire W does not slip off the end of the pin 34 after it has been engaged. The snagger 30 is shown secured to the snagger plate 26 by means of a bolt 30*a* which is threadedly engaged at one end to nut 30*b* and at the other end connected by means of a pin 30*c* to the snagger 30. The snagger 30 is also resiliently mounted relative to the snagger plate 26 by means of a bolt 30*d* which is connected at one end to nut 30*e* which captures compression spring 30*f* as shown. The other end of the bolt 30*d* is connected to the snagger by means of pin 30*g*. With this arrangement, it should be clear, the snagger 30 can move at least to small extents, as a function of the tension of the spring 30*f* to separate from the snagger plate 26 and resiliently receive a wire W to thereby wedge and retain the wire under compression and thereby prevent inadvertent escape of the wire following snagging. Clearly, the specific consrtructions of the pins 34 and snaggers 30 are merely illustrative of a preferred embodiment and are not critical for purposes of the present invention.

It will be understood that the foregoing relates only to a preferred embodiment of the present invention and that numerous modifications and alterations may be made therein without departing from the spirit and scope of the invention as set forth in the appended claims.

What is claimed is:

1. In a continuous dual spooler of the type having a housing and two spaced arbors mounted for rotation on the housing and adapted to mount reels for rotation therewith, drive means for driving the arbors to wind wire on an empty reel while slowing down and stoping a full reel thereby permitting replacement thereof with an empty reel, guide means for guiding the wire proximate the empty reel during transfer of the wire from the full reel to the empty reel, and cutter means for severing the continuous incoming wire at the full reel during wire transfer, the improvement comprising snagger means associated with each arbor for snagging the wire at the empty reel at the commencement of wire transfer and for winding initial turns of wire onto the empty reel; wire take-off means associated with each arbor for engaging the snagged wire between said snagger means and the empty reel and for unwinding a length of wire from the initial turns of wire wound on the empty reel; and control means for timing and controlling said snagger and take-off means relative to said arbors and the reels to provide full reels with long ends having predetermined desired lengths, said control means includes means for maintaining said snagger and take-off means rigidly coupled with the associated arbor on which a reel is mounted during wire winding and for releasing the arbor to allow the reel to become free wheeling during wire-take-off while selectively rotating said take-off means relative to said snagger, whereby the reel is permitted to unwind initial turns to provide a long end by the action of said take-off means applying a tension on the wire extending between the associated snagger and reel.

2. A dual spooler as defined in claim 1, wherein each arbor defines an axis of rotation and wherein each snagger means comprises a snagger plate mounted proximate to a flange of a reel which is mounted on an associated arbor and mounted for rotation relative to and about the axis of an associated arbor, and at least one snagger mounted on each snagger plate for snagging the wire at a distance from the arbor axis beyond the rim of the flange of the empty reel.

3. A dual spooler as defined in claim 2, wherein each wire take-off means comprises wire-engaging means mounted for rotation about the axis of an associated arbor in a plane substantially parallel to an associated snagger plate, each wire engaging means being radially disposed between an associated snagger and the rim of the empty reel.

4. A dual spooler as defined in claim 3, wherein said wire take-off means comprises an auxiliary plate mounted for rotation relative to and about the axis of an associated arbor, said wire-engaging means being mounted on said auxiliary plate.

5. A dual spooler as defined in claim 4, wherein said auxiliary plate is disposed between an associated snagger plate and the flange of a reel mounted on an associated arbor.

6. A dual spooler as defined in claim 5, wherein said wire-engaging means comprises a protuberance mounted on the associated auxiliary plate extending in the direction of said reel and the wire snagged by an associated snagger.

7. A dual spooler as defined in claim 6, wherein said protuberance means comprises a pin.

8. A dual spooler as defined in claim 7, wherein two pins are provided on each auxiliary plate which are disposed on diametrically opposite sides with respect to the axis of rotation of said auxiliary plate.

9. A dual spooler as defined in claim 8, wherein associated snaggers and pins are concentrically mounted for rotational movements about a respective arbor.

10. A dual spooler as defined in claim 3, wherein said control means includes means for rotatably shifting said snagger and wire-engaging means relative to each other by approximately 180° about the axis of the associated arbor prior to transfer and wire take-off.

11. A continuous dual spooler having:

(a) housing;

(b) two spaced arbors mounted for rotation on said housing about substantially parallel axes and adapted to mount reels for rotation therewith;

(c) drive means for driving said arbors during a wire winding mode to rotate one initially empty reel while slowing down and stoping the other full reel thereby permitting replacement thereof with an empty reel;

(d) guide means for guiding a continuous incoming wire onto the reel being wound during a winding mode and proximate to the empty reel during a transfer mode;

(e) cutter means for severing the continuous incoming wire at the full reel during the transfer mode;

(f) at least one snagger mounted for independent rotation about the axis of an associated arbor proximate to and radially outwardly of the rim of a flange of a reel mounted on the respective arbor for snagging the wire at the empty reel at the commencement of wire transfer and for winding initial turns of wire onto the empty reel;

(g) at least one wire engaging member mounted for independent rotation about the axis of an associated arbor in proximity to a flange of a reel mounted on the respective arbor at a radial distance between the reel rim and said at least one snagger for engaging the snagged wire at a radial distance between an associated snagger and the initially wound reel for unwinding a length of wire from the initial turns of wire wound on the empty reel; and (h) control means for maintaining synchronous rotation between each arbor and associated snaggers and wire engaging members during winding of a reel and for free-wheeling the arbor supporting an empty reel while selectively rotating a wire engaging member relative to an associated snagger whereby the reel is permitted to unwind initial turns to provide a long end by the action of said wire engaging means applying a tension on the wire extending between the associated snagger and reel.

12. A continuous dual spooler as defined in claim 11, wherein said at least one snagger and wire engaging member are mounted for rotation substantially in a plane at least partially coextensive with said wire path.

13. A continuous dual spooler as defined in claim 12, wherein said snagger and wire engaging member are mounted on associated disc plates mounted for independent rotation about the axes of said arbors.

14. A continuous dual spooler as defined in claim 12, including means for preventing engagement of the wire by said wire engaging member prior to engagement by an associated snagger.

15. A continuous dual spooler as defined in claim 11, wherein said control means includes clutch means for releasing said arbors, thereby permitting relative movements between said arbors, snaggers and wire engaging members.

16. A continuous dual spooler as defined in claim 11, wherein said control means includes a differential transmission for regulating angular movements between said snaggers and wire engaging members.

17. A method of winding reels having long ends with desired preselected lengths, wherein an empty reel having flanges and a drum is mounted for rotation on an arbor, a snagger mounted for independent rotation about the axis of the arbor radially remotely from the flanges of the reel, and a wire-engaging member is mounted for independent rotation about the axis of the arbor radially disposed between the reel flanges and the snagger, the method comprising the steps of:

(a) snagging the wire to be wound onto the reel;

(b) winding initial turns of the wire on the drum of the reel;

(c) free-wheeling the arbor to allow relative rotation between the reel and the snagger and wire-engaging member;

(d) selectively rotating the wire-engaging member relative to the snagger to effectively unwind a selected desired length of wire from the initial turns wound on the drum of the reel; and (e) rotating the arbor, snagger and wire engaging member synchronously after a desired length of long end has been achieved to thereby continue winding of the reel until said reel is fully wound.

* * * * *